US005726144A

United States Patent [19]

Dewez et al.

[11] Patent Number: 5,726,144

[45] Date of Patent: Mar. 10, 1998

[54] STABLE FABRIC SOFTENER COMPOSITIONS

[75] Inventors: Jacques Dewez, Battice; Eric Thibert, Herve, both of Belgium

[73] Assignee: Colgate-Palmolive Company, New York, N.Y.

[21] Appl. No.: 697,799

[22] Filed: Aug. 30, 1996

Related U.S. Application Data

[60] Provisional application No. 60/003,012, Aug. 31, 1995.

[51] Int. Cl. [6] ..... D06M 13/46

[52] U.S. Cl. ..... 510/522; 510/101; 510/515

[58] Field of Search ..... 510/515, 522, 510/101

[56] References Cited

U.S. PATENT DOCUMENTS

| | | | |
|---|---|---|---|
| 4,128,484 | 12/1978 | Barford et al. | 510/525 |
| 4,476,030 | 10/1984 | May et al. | 510/524 |
| 5,133,385 | 7/1992 | Contor et al. | 510/521 |
| 5,501,806 | 3/1996 | Farooq et al. | 510/522 |

FOREIGN PATENT DOCUMENTS

| | | |
|---|---|---|
| 000406 | 1/1979 | European Pat. Off. . |
| 018039 | 10/1980 | European Pat. Off. . |
| 0243735 | 11/1987 | European Pat. Off. . |
| 0423894 | 4/1991 | European Pat. Off. . |
| 0443313 | 8/1991 | European Pat. Off. . |
| 536444 | 4/1993 | European Pat. Off. . |
| 0634475 | 1/1995 | European Pat. Off. . |

*Primary Examiner*—Anthony Green
*Attorney, Agent, or Firm*—Bernard Lieberman

[57] ABSTRACT

Fabric softening compositions which form and maintain stable aqueous dispersions in the absence of added oily perfume are disclosed. The stability of aqueous fabric softener compositions based on a mixture of an amido amine, such as bis(tallow amidoethyl)-2-hydroxyethyl amine and a quaternary diester fabric softener, such as N-methyl, N,N, N-triethanolamine ditallow ester quaternary ammonium salt is enhanced by inclusion in the composition of at least one fatty ester of a fatty acid or fatty alcohol, e.g., glycerol monostearate.

26 Claims, No Drawings

STABLE FABRIC SOFTENER COMPOSITIONS

This application claims the benefit of U.S. Provisional application Ser. No. 60/003,012, filled on Aug. 31, 1995.

BACKGROUND OF THE INVENTION

1. Field of the Invention

The present invention relates to fabric softener compositions and water-dilutable concentrates for addition to the rinse cycle in the fabric washing process.

2. Description of Related Art

Aqueous compositions containing quaternary ammonium salts or imidazolinium compounds having at least one long chain hydrocarbyl group are commonly used to provide fabric softening benefits when used in a laundry rinse operation. Numerous patents have been issued for these types of compounds and compositions.

More recently, however, in view of concerns for the environmental safety (e.g. biodegradability) of the quaternary compound softeners, as well as limits in the amounts of these cationic compounds which can be stably incorporated in the more convenient to use liquid formulations, there have been many proposals for partial or total replacements of the conventional "quat" fabric softeners which are exemplified by dimethyl distearyl (or ditallow) ammonium chloride and various imidazolinium compounds.

Amido or ester amine compounds have been discovered which are more attractive as fabric softeners because they more readily biodegrade.

The compounds are organic or inorganic salts of compounds having the general formula I:

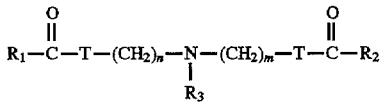

I wherein $R_1$ and $R_2$, independently, represent $C_{12}$ to $C_{20}$ alkyl or alkenyl; $R_3$ represents $CH_2CH_{20})pH$, $CH_3$ or H; T represents O or NH; n and m are each, independently, a number of 1 to 5; and p is a number of from 1 to 10.

However, use of these compounds in combination with fatty emulsifiers in concentrated fabric softener aqueous dispersions or emulsions an levels in excess of about 10–11% by weight of the amine can cause a marked increase in the viscosity of the product (>2500 mPas), even in the presence of electrolytes (e.g. $CaCl_2$) or solvents, such that the product is not readily pourable from the container in which it is packaged.

Viscosity control and enhanced softening power in such aqueous compositions is achieved by combining the amido or ester amine of the formula I above with a biodegradable fatty ester quaternary ammonium compound (esterquat) of the formula II:

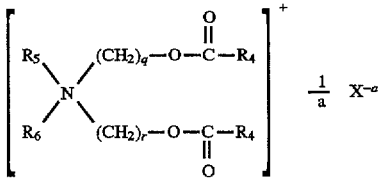

II where each $R_4$, independently, represents an aliphatic hydrocarbon group having from 8 to 22 carbon atoms; $R_5$ represents $(CH_2)_s$-$R_7$ (where $R_7$ represents an alkoxy carbonyl group containing from 8 to 22 carbon atoms, benzyl, phenyl, $(C_1-C_4)$ alkyl substituted phenyl, OH or H); $R_6$ represents $(CH_2)_t$-$R_8$ (wherein $R_8$ represents benzyl, phenyl, $(C_1-C_4)$ alkyl substituted phenyl, OH or H); q, r, s and t, each independently, represent a number of from 1 to 3; and $x^{-a}$ is an anion of valence a.

Such compositions containing formula I and II components also contain an electrolyte salt as a gelation preventer to provide enhanced viscosity reduction. U.S. Pat. No. 5,135,885 and copending U.S. application Ser. No. 08/213,308, filed Mar. 14, 1994, discloses aqueous based fabric softener concentrates containing species of the above described amido or ester amides and esterquat compounds.

The fabric softener (in concentrate or ready-to-use form) normally is formulated as an aqueous dispersion (macroemulsion) and also contains from about 0.25 to about 3% by weight of an added oil-based perfume to enhance consumer appeal. Concentrates formulated to be diluted by the consumer prior to use generally contain the perfume at high levels, e.g. from about 1–3% by weight. Typical perfumes are odoriferous materials based on floral extracts or woody-earthy bases containing exotic materials such as sandalwood oil, civet or patchouli oil. The perfume is normally added to a molten mixture of the softening agents just prior to emulsification in water.

However, in some cases it is desirable to formulate amido or ester amine/esterquat aqueous dispersions without addition of any perfume or with very little added perfume. This would allow the manufacturer to prepare large fabric masterbatches, portions of which could then be combined with different types of perfume to satisfy the different appeals of different consumers. Also, the provision of non-perfumed formulations would allow the consumer to select one of a number of different perfume scents supplied with the product and mix the desired scent with the fabric softener composition prior to use.

Attempts to prepare emulsion masterbatches containing amido or ester amine/esterquat softening agents as described above without added perfume have demonstrated that the presence of the perfume is necessary in order to obtain emulsions having a stable viscosity. The perfume has been found to serve a physical/chemical role in the achievement of emulsions which maintain viscosity and which do not separate after periods of storage, since perfume-free emulsions of the type described herein are not viscosity stable after periods of ageing.

Accordingly, it is a primary object of this invention to provide stable fabric softener aqueous dispersion which remain stable in the absence of added oily perfume.

SUMMARY OF THE INVENTION

The present invention provides a stable fabric softener composition in the form of an aqueous dispersion (emulsion) which remains stable in the absence of added oily perfume, comprising a mixture of:

(i) from about 3 to about 40% by weight of a fabric softener combination comprising a mixture of A and B, wherein (A) is an inorganic acid salt of a fabric softening compound of formula:

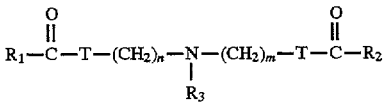

$R_1$ and $R_2$ represent $C_{12}$ to $C_{30}$ aliphatic hydrocarbon groups, $R_3$ represents $(CH_2CH_2O)_pH$, $CH_3$ or H;

T represents O or NH;

n=1 to 5, m=1 to 5, and p=1 to 10; and (B) is biodegradable fatty ester quaternary ammonium compound of formula:

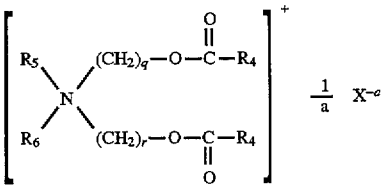

wherein each $R_4$, independently, represents an aliphatic hydrocarbon group having from 8 to 22 carbon atoms, $R_5$ represents $(CH2)_s$-$R_7$ (where $R_7$ represents an alkoxy carbonyl group containing from 8 to 22 carbon atoms, benzyl, phenyl, $(C_1-C_4)$-alkyl substituted phenyl, OH or H); $R_6$ represents $(CH_2)_t$-$R_8$ (wherein $R_8$ represents benzyl, phenyl, $(C_1-C_4)$ alkyl substituted phenyl, OH or H); q, r, s and t, each independently represent a number of from 1 to 3; and x is an anion of valence a; said mixture further characterized that at least about 20% of the hydrocarbon substituent groups present in components A and B are unsatured;

(ii) a fatty ester of mono- or polyhydric alcohols having from 1 to about 24 carbon atoms in the hydrocarbon chain and mono- polycarboxylic acids having from 1 to about 24 carbon atoms in the hydrocarbon chain, provided that the total number of carbon atoms in the ester is equal to or greater than 16 and that at least one of the hydrocarbon radicals in the ester has 12 or more carbon atoms, said fatty ester being present in the composition such that the weight ratio of component (i) to component (ii) is in the range of from about 40:1 to about 5:1; and (iii) an aqueous carrier including an anti gelling amount of electrolyte.

The present invention also provide a method of imparting softness to fabrics by contacting the fabrics with a softening effective amount of the invention fabric softener composition, generally and preferably in the rinse cycle of an automatic laundry washing machine. The compositions may be diluted with water prior to adding the composition to the washing machine (e.g., the rinse cycle dispenser), or may be added, at reduced amount, without dilution, i.e., ready to use.

Stable masterbatch compositions prepared herein may be perfumed prior to packaging or unperfumed packaged compositions may be supplied to the consumer and separately perfumed by the consumer prior to use.

DETAILED DESCRIPTION OF THE INVENTION

The fabric softening active ingredient A described above is an amido tertiary amine or an ester tertiary amine.

In the above formula for component A, $R_1$ and $R_2$ are each, independently, long chain aliphatic hydrocarbons, e.g., alkyl or alkenyl groups having from 12 to 30 carbon atoms, preferably from 16 to 22 carbon atoms. Linear hydrocarbon groups, such as, for example dodecyl, dodecenyl, octadecyl, octadecenyl, behenyl, eicosyl, etc., are preferred. Typically, $R_1$ and $R_2$, and more generally $R_1$—CO—and $R_2$—CO, will be derived from natural oils containing fatty acids or fatty acid mixtures, such as coconut oil, palm oil, tallow, rape oil, and fish oil. Chemically synthesized fatty acids are also usable. Generally and preferably $R_1$ and $R_2$ are derived from the same fatty acid or fatty acid mixture. When $R_1$ and $R_2$ are derived from or contain up to about 80%, but preferably not more than 65% by weight of unsaturated (i.e., alkenyl) groups, the relatively poor softening performance of unsaturated moieties of the compound is overcome by the combination with the ester quat compound of formula B and an effective amount of a viscosity reducing electrolyte.

$R_3$ in formula A represents $(CH_2CH_2O)_pH$, $CH_3$, or H, or mixtures thereof. When $R_3$ represents the preferred $(CH_2CH_2O)_pH$ group, p is a positive number representing the average degree of ethoxylation, and is preferably from 1 to 10, especially 1.4 to 6, and more preferably from about 1.5 to 4, and most preferably, from 1.5 to 3.0. n and m are integers of from 1 to 5, preferably 1 to 3, especially 2. The compounds of formula A in which $R_3$ represents the preferred $(CH_2CH_2O)_pH$ group are broadly referred to herein as ethyoxylated amidoamines (T=NH) or ethoxylated ester amines (T=0), and the term hydroxyethyl is also used to describe the $(CH_2CH_2O)_pH$ group.

Suitable amidoamines for use herein include those sold under the tradename Varisoft™ 510, 511 and 512 by Shreex Chemical company or sold under the tradename Rewopal™ V3340 by Rewo of Germany.

The fabric softening active ingredient B described above is a quaternized ester compound. Each $R_4$ in formula B independently represents an aliphatic hydrocarbon group having from 8 to 22 carbon atoms, and preferably 14 to 18 carbon atoms. $R_5$ represents the group $(CH_2)_s$-$R_7$ which, depending on $R_7$, may represent a long chain alkyl ester group ($R_7$=$C_8$–$C_{22}$ alkoxy carbonyl), in which case the compounds of formula B are triester quaternary ammonium compounds.

Preferably, however, the fatty ester quaternary compounds are diester compounds, i.e. $R_7$ represents benzyl, phenyl, phenyl substituted by $C_1$–$C_4$ alkyl, hydroxyl (OH) or hydrogen (H). Most preferably $R_7$ represent OH or H, especially preferably OH, e.g. $R_5$ is hydroxyethyl.

q, r and s, each, independently, represents a number of from 1 to 3.

X represents a counter ion of valence a.

X is preferably an anion selected from the group consisting of halo, sulfate, methosulfate, nitrate, acetate, phosphate, benzoate or oleate.

In a more preferred embodiment, each $R_4$ in formula B may be, for example, derived from hard or soft tallow, coco, stearyl, oleyl, and the like. Such compounds are commercially available, for example, Tetranyl AT-75, from Kao Corp. Japan, which is di-tallow ester trierhanol amine quaternary ammonium methyl sulfate. Tetranyl AT-75 is based on a mixture of about 25% hard tallow and about 75% soft tallow. Accordingly, this product contains about 34% of unsaturated alkyl chains. A second example would be Hipochem X-89107, from High Point Chemical Corp.; which is an analogue of the Tetranyl AT-75 with about 100% saturation in the tallow moieties. However, in general, the quaternized ammonium ester compound of formula B may contain from about 5% to about 75% of unsaturated (long-chain) alkyl groups, preferably from about 20% to about 50% of unsaturated long-chain alkyl groups.

Best fabric softener performance is achieved where from at least about 20% up to about less than 70% of the combined hydrocarbon substituent group present in A and B are unsatured.

The compounds of formula A and B are used in admixture, preferably in ratios of about 5:1 to about 1:5, more preferably from 2:1 to 1:2, especially 1.7:1 to 1:1.7, whereby both softening performance and stability and pourability are improved. That is, notwithstanding the poor softening performance of the unsaturated long-chain alkyl compounds when used individually, when used with the ester quat compound (which also preferably contains carbon to carbon double bonds), either alone or in combination with the hydrogenated amido amine compound, a surprisingly substantial improvement in softening performance is observed in pourable liquid formulations.

The total amounts of components A and B present in the composition is from about 3 to about 40 wt. percent, preferably from about 4 to about 30 wt. %, and the ratio, by weight of A:B is from about 2:1 to 1:2, and especially, from about 1.7:1 to 1:1.

These softener components are more particularly described in U.S. Pat. No. 5,133,885 and copending U.S. application Ser. No. 08/213,308, the complete disclosures of which are incorporated herein by reference.

The emulsion or dispersion stabilizers used herein are fatty alkyl esters which may be derived from mono- or polyhydric alcohols having from 1 to about 24 carbon atoms in the hydrocarbon chain, and mono- or polycarboxylic acids having from 1 to about 24 carbon atoms in the hydrocarbon chain, with the provisos that the total number of carbon atoms in the ester is equal to or greater than 16 and at least one of the hydrocarbon radicals in the ester has 12 or more carbon atoms.

The acid portion of the fatty ester can be obtained from mono- or polycarboxylic acids having from 1 to about 24 carbon atoms in the hydrocarbon chain. Suitable examples of monocarboxylic acids include behenic acid, stearic acid, oleic acid, palmitic acid, myristic acid, lauric acid, acetic acid, propionic acid, butyric acid, isobutyric acid, valeric acid, lactic acid, glycolic acid and dihydroxyisobutyric acid. Examples of suitable polycarboxylic acids include: n-butylmalonic acid, isocitric acid, citric acid, maleic acid, malic acid and succinic acids.

The alcohol radical in the fatty ester can be represented by mono- or polyhydric alcohols having from 1 to 24 carbon atoms in the hydrocarbon chain. Examples of suitable alcohols include: behenyl, arachidyl, cocoyl, oleyl and lauryl alcohols, ethylene glycol, glycerol, polyglycerol, ethanol, isopropanol, vinyl alcohol, diglycerol, xylitol, sucrose, erythritol, pentaerythritol, sorbitol or sorbitan.

Preferred fatty esters are ethylene glycol, glycerol, pentaerythritol and sorbitan esters wherein the fatty acid portion of the ester normally comprises a species selected from behenic acid, stearic acid, oleic acid, palmitic acid or myristic acid.

Specific examples of fatty alcohol esters for use herein include: stearyl acetate, palmityl di-lactate, cocoyl isobutyrate, oleyl maleate, oleyl dimaleate, and tallow propionate. Fatty acid esters useful in the present invention include: methyl oleate, xylitol monopalmitate, pentaerythritol monoleate or monostearate, sucrose monostearate, glycerol monostearate or monoleate, ethylene glycol monostearate and sorbitan esters. Suitable sorbitan ester include sorbitan monostearate, sorbitan palmirate, sorbitan monolaurate, sorbitan monomyristate, sorbitan monobehanate, sorbitan monoleate, sorbitan dilaurate, sorbitan distarate, sorbitan dibehenate, sorbitan di- or trioleate, and also mixed tallowalkyl sorbitan mono- and di-esters. Glycerol esters are equally highly preferred in the composition herein. These are the mono-, di-, or tri-esters of glycerol and the fatty acids of the class described above. Glycerol monostearate, glycerol mono-oleate, glycerol monopalmitate, glycerol monobehenate, and glycerol distearate are specific examples of these preferred glycerol esters.

The most preferred esters for use herein are fatty esters of $C_{16}$–$C_{18}$ unsaturated fatty acids (e.g. oleic acids) with $C_1$ to $C_8$ mono- or polyhydric alcohols such as methanol, ethanol, sorbital, pentaerythritol, glycerol and polyglycerol. Preferred esters also have an HLB (Hydroliphic Balance) value in the range of about 0.5 to 5, more preferably from about 2 to 3. Glycerol monooleate is a particularly preferred fatty acid ester.

These fatty esters are incorporated into the composition at levels such that the weight ratio of the mixed fabric softener components A and B to fatty ester is in the range of from about 40:1 to about 5:1, more particularly from about 28:1 to about 9:1. Generally speaking, the composition should contain from about 0.2 to about 2% by weight of the fatty ester component.

The fatty ester component functions as a dispersion or emulsion stabilizer in much the same way as the oily perfume component of perfumed dispersions. The fatty ester thus permits the preparation of stable unperfumed dispersions having pourable viscosities which will not separate after periods of storage.

In the non-neutralized form, the fatty amide and fatty ester tertiary amine compounds of formula A are not readily dispersible in water. Therefore, the amine function of amidoamine or ester amine compound is at least partially neutralized by a proton contributed by a dissociable acid, which may be inorganic, e.g., HCl, $H_2SO_4$, $HNO_3$, etc. or organic, e.g. acetic acid, propionic acid, lactic acid, citric acid, glycolic acid, toluene sulfonic acid, maleic acid, fumaric acid, and the like. Mixtures of these acids may also be used, as may any other acid capable of neutralizing the amine function. The acid neutralized compound is believed to form a reversible complex, that is, the bond between the amine function and proton will disappear under alkaline pH conditions. This is in contrast to quaternization, e.g., with a methyl group, wherein the quaternizing group is covalently bonded to the positively charged amine nitrogen and is essentially pH independent.

The amount of acid used will depend on the "strength" of the acid; strong acids such as HCl, and $H_2SO_4$ completely dissociate in water, and, therefore, provide a high amount of free protons (H+), while weaker acids, such as citric acid, glycolic acid, lactic acid, and other organic acids, do not dissociate completely and, therefore, require a higher concentration to achieve the same neutralizing effect. Generally, however, the amount of acid required to achieve complete protonation of the amine, will be achieved when the pH of the composition is rendered strongly acidic, namely between about 1.5 and 4. HCl and glycolic acid are preferred, and HCl is especially preferred.

The amount of acid used will normally range from about 0.20 to 1.5% by weight, depending on acid type and strength.

The compositions of this invention are provided as aqueous dispersion in which the fabric softener compounds of formula A and formula B are present in finely divided form stably dispersed in the aqueous phase. Generally, particle sizes of the dispersed particles of less than about 25 microns (μm), preferably less than 20 μm, especially preferably no more than 10 μm, on average are acceptable for both softening and stability insofar as the particle sizes can be maintained during actual use, typically in the rinse cycle of an automatic laundry washing machine. The lower limit is not particularly critical but from a practical manufacturing standpoint will not generally be below about 0.01 μm, preferably at least about 0.05 μm. A preferred particle size range of the dispersed softener ingredients is from about 0.1 to about 8 μm.

The aqueous phase of the dispersion is primarily water, usually deionized or distilled water. Small amounts (e.g. up to about 5% by weight) of co-solvent may be present for adjustment of viscosity. Typically, lower mono- and polyhydroxy alcohols will be used as the cosolvent, generally in amounts up to about 8% by weight of the composition. The preferred alcohols are those having from 2 to 4 carbon atoms, such as, for example, ethanol, propanol, isopropanol, an propylene glycol or ethylene glycol. Isopropyl alcohol (2-propanol) is especially preferred. However, co-solvents are not required and are generally avoided.

The compositions of this invention include an electrolyte to reduce dispersion viscosity. Generally, any of the alkali or alkaline earth metal salts of the mineral acids can be used as electrolyte. In view of availability, solubility and low toxicity, NaCl, $CaCl_2$, $MgCl_2$ and $MgSO_4$ and similar salts are preferred, and $CaCl_2$ is especially preferred. The amount of the electrolyte will be selected to assure that the composition does not form a gel. Generally, amounts of electrolyte salt of from about 0.0075 to 2.0 wt. %, preferably 0.05 to 1.5 wt. %, may be used.

An optional ingredient which may be present in the compositions is a rheology modifier to help reduce or eliminate variations in the aqueous dispersion viscosity over time. It should be understood, however, that so long as the viscosity does not increase to an unacceptably high level over the expected life of the product (including transportation from the manufacturing plant to the market place, shelf-life in the market place, and duration of consumption by the end user) a rheology modifier is not necessary. For example, the viscosity after, for instance, 8 to 10 weeks, should preferably not exceed about 1500 cps (at 25° C.), especially preferably the viscosity should not exceed about 1000 cps (at 25° C.) over the expected lifetime of the product. In many cases, initial viscosities of up to about 200 cps can be achieved and maintained.

Therefore, if there is concern about increase in product viscosity, or if changes in viscosity over time are considered undesirable, a rheology modifier can be added to the composition. Examples of rheology modifiers are well known in the art and may be chosen from, for example, polymeric rheology modifiers and inorganic rheology modifiers. Examples of the former type include polyquaternium compounds, such as Polyquaternium-24 (a hydrophobically modified polymeric quaternary ammonium salt hydroxyethyl-cellulose, available from Amercho, Inc.); cationic polymers such as copolymers of acrylamide and quaternary ammonium acrylate; the Carbopols, and the like. Examples of inorganic rheology modifiers include, for example, alumina. Generally, only minor amounts, up to about 1.0%, preferably up to about 0.8%, such as, for example, 0.01 to 0.60 percent by weight, provide acceptable viscosity levels over time.

Other optional additive components commonly used in fabric softening compositions may be added in minor amounts to enhance either the appearance or performance properties of the liquid fabric softener compositions of this invention. Typical additives of this type include, but are not limited to colorants, e.g., dyes or pigments, bluing agents, preservatives, germicides, perfumes and thickeners.

The subject liquid fabric softener compositions may be prepared by adding the active ingredients, i.e., compounds A and B, and the fatty ester, usually as a melt, to the heated aqueous phase to which the acid component has been pre-mixed, under mixing conditions. Low-shear mixing is generally sufficient to adequately and uniformly disperse the active ingredients in and throughout the aqueous phase. Further particle size reduce can be obtained by subjecting the composition to further treatment such as in a colloid mill or by high pressure homogenization.

The final product, whether in concentrate or diluted form must be easily pourable by the end user. Generally, therefore, final product viscosity (for a freshly prepared sample) should not exceed about 1500 centipoise (mPa), preferably not more than 1000 centipoise, but should not be too low, for example not less than about 20 centipoise. The preferred viscosity for the invention concentrated product is in the range of 35 to 1000 centipoise. As used herein, unless otherwise specified, viscosity is measured at 25° C. (22°–26° C.,) using a Brookfield Viscometer Model RVTDV-II at 50 RPM using spindle n°2 below 800 cps, n°3 above 800 and below 2,000 cps, and spindle n°4 above 2,000 and below 4,000 cps.

The dispersions of this invention may be provided in ready to use form or as concentrates containing a higher level of active ingredients. Concentrates will generally be formulated for dilution with from about one to six volumes of water per volume of concentrate.

In addition, perfumes may be added directly to the fabric softener formulations prior to packaging without the necessity to pre-emulsify the perfume component. Also, perfume may be added directly by the consumer prior to use of the fabric softener in the washing cycle. Thus the fabric softener may be differentiated to appeal to different consumer desires.

The following examples are illustrative of the invention.

EXAMPLE 1

This example illustrates the preparation of a masterbatch (MB) composition containing about 14.3 wt. % active ingredients.

The following ingredients were combined to make a perfume-free masterbatch having an active ingredient (AI) content of about 14.3% (AI=amido amine and esterquat):

| RAW MATERIAL | NOMINAL % |
|---|---|
| Amidoamine partially hydrogenated (Rewopal ™ V3340) | 8.93 |
| Esterquat partially hydrogenated (Tetranyl AT 750) | 5.36 |
| Glycerol monooleate (Radiasurf 7150) | 1.02 |
| Hydrochloric acid | 0.47 |
| Preservative (Lactic/lactate) | 0.26 |
| Calcium chloride dihydrate | 0.09 |
| Deionized water | balance |

The mixing procedure employed was to charge a premix tank with molten amido amine, molten ester quat and molten fatty acid ester and heat to 65° C. The main tank was charged with deionized water and heated to 65° C. The HCl is then added under agitation and the content of the premix tank is next added under high agitation. The electrolyte (in solution) and preservative are then added. The product is mixed for about 10 minutes and then cooled down to 30° C.

Control A

A control perfume-free masterbatch was prepared as described in Example 1 above except that the glycerol monooleate was left out of the formulation.

Control B

A control perfume-containing masterbatch was prepared as described above except that the glycerol monooleate was left out of the formulation and 1.5 parts of perfume was included in the formulation. The perfume was comprised of terpenes, natural extracts, a mixture of terpenic and aromatic alcohols, esters of terpenic and aromatic alcohols, lactone, polyglycols and musk.

A finished product (FP) containing about 14 wt. % AI was prepared by mixing 98 parts by weight of the Example 1 masterbatch with 1.5 parts perfume and 0.5 parts of a dye solution.

A 3.1 wt. % AI finished product (4:1 dilution) was prepared by combining 24.5 parts by weight of the Example 1 masterbatch with 0.32 parts perfume, 0.5 parts dye solution, 0.3 parts thickener and the balance water to 100 parts by weight total.

Viscosity measurements were taken on these formulations immediately after making (as made=AM), after 1 day storage and after 12 weeks storage, at 4° C., room temperature (RT), 35° C. and 43° C.

Results are shown in Table 1.

TABLE 1

| | Brookfield Viscosity (cps) | | | | | |
|---|---|---|---|---|---|---|
| FORMULA | AM | 1 day | 4° C. | RT | 35° C. | 6 Weeks 43° C. |
| Ex. 1 | 44 | 43 | 44 | 41 | 36 | 49 |
| 14% AI FP | 48 | 43 | 45 | 38 | 38 | 38 |
| 3.5% AI FP | 144 | 153 | 161 | 154 | 154 | 165 |
| CONTROL A | 1174 | 990 | 1780 | 856 | 1188 | 157 |
| CONTROL B | 45 | 39 | 38 | 40 | 32 | 32 |

The above results demonstrate that the viscosity of the products of the invention remained stable over an extended period of time. No separation of the product into separate layers was observed. Control A, which did not contain the fatty ester, exhibited a markedly higher viscosity as made and after standing. The addition of perfume to Control A (Control B) resulted in a viscosity stable emulsion comparable to the products of the invention.

EXAMPLE 2

A series of three different masterbatch products (perfumed products, unperfumed products and stabilized unperfumed products) containing about 28 wt. % amido amine and esterquat active ingredients were prepared by the procedure as in Example 1 and evaluated for viscosity stability. The perfume used was the same as described in Control B above. The composition of these formulations with reference to Tables 2–4 was as follows:

TABLE 2

| Perfumed Products | |
|---|---|
| Ingredient | Nominal % (AI) |
| Water | balance |
| Hydrochloric acid | 0.92 |
| Amidoamine | 17.5 |
| Esterquat | 10.5 |
| Perfume | 2 or 2.4 |
| $MgCl_2.6H_2O$ | 0.64 |
| Dye | 0.01 |

TABLE 3

| Unperfumed products | |
|---|---|
| Water | balance |
| Hydrochloric acid | 0.95 |
| Amidoamine | 18.0 |
| Esterquat | 10.8 |
| $MgCl_2.6H_2O$ | 0.66 |

TABLE 4

| Stabilized unperfumed products | |
|---|---|
| Water | balance |
| Hydrochloric acid | 0.92 |
| Amidoamine | 17.5 |
| Esterquat | 10.5 |
| Stabilizing Ester | 2 |
| $MgCl_2.6H_2O$ | 0.64 |

These formulations were evaluated for viscosity stability with the following results:

TABLE 2

| Perfumed Product | Brookfield Viscosity (cps) | | | | | |
|---|---|---|---|---|---|---|
| Perfume Level % | AM | 1 day | 4° C. | RT | 35° C. | 6 Weeks 43° C. |
| 2.4 | 73 | 63 | 94 | 71 | 65 | 69 |
| 2 | 68 | 58 | 84 | 71 | 66 | 66 |

TABLE 3

| Unperfumed Products | Brookfield Viscosity (cps) | | | | | |
|---|---|---|---|---|---|---|
| | AM | 1 day | 4° C. | RT | 35° C. | 6 Weeks 43° C. |
| 1 | 148 | 1470 | 1580 | 1380 | 1110 | >4000 |
| 2 | 117 | 195 | 312 | 265 | 266 | 1350 |
| 3 | 86 | 650 | 810 | 625 | 486 | 3160 |
| 4 | 58 | 152 | 410 | 255 | 317 | 1300 |

TABLE 4

| Ester 2% | Stabilized Unperfumed Products Brookfield Viscosity (cps.) AM 1 day | | 4° C. | RT | 35° C. | 6 Weeks 43° C. |
|---|---|---|---|---|---|---|
| a | 88 | 91 | 144 | 104 | 94 | 80 |
| b | 84 | 94 | 161 | 105 | 101 | 141 |
| c | 78 | 87 | 149 | 105 | 80 | 69 |
| d | 78 | 87 | 110 | 81 | 63 | 59 |
| e | 83 | 109 | 174 | 114 | 98 | 110 |
| f | 73 | 70 | 140 | 80 | 65 | 65 |

Stabilizing Ester
a = sorbitan monooleate
b = sorbitan trioleate
c = pentaerythritol monooleate
d = glycerol monooleate
e = polyglycerol monooleate
f = methyl oleate These results again demonstrate the relative viscosity stability of formulations containing the perfume (Table 2), poor viscosity stability of compositions free of both perfume and ester (Table 3) and good viscosity stability of unperfumed formulations containing various esters within the scope of the invention as stabilizers (Table 4).

The viscosity stable emulsions of the present invention may be supplied to the consumer as concentrates and free of added perfume, and the water and perfume separately added by the consumer. Concentrates may be diluted by the consumer with 0.5 to 6 parts water per part of concentrate. Post addition of perfume (and water) to the concentrate may be accomplished by simply mixing in the perfume (and water) at ambient temperatures. Such post addition of these ingredients does not effect or destroy the viscosity stability of the emulsion. This is illustrated by the following example.

EXAMPLE 3

An unperfumed product containing about 21% amido amine/esterquat active ingredients was prepared by the procedure of Example 1. This PF-free (perfume free) product had the following composition:

| | |
|---|---|
| Water | balance |
| Hydrochloric acid | 0.69 |
| Amidoamine | 13.12 |
| Esterquat | 7.88 |
| Glycerol monooleate | 1.8 |
| $CaCl_2.2H_2O$ | 0.2 |

A sample of this product at room temperature was then perfumed and dyed by gently mixing in 1.8% perfume and 0.01% dye and viscosity measurements were taken as made and at other times and temperatures as shown in Table 5. Three other samples were perfumed 1, 7 and 14 days after making as shown in Table 5.

Viscosity results were as follows:

TABLE 5

| Post add time (days) | Brookfield Viscosity (cps) AM 1 day | | 4° C. | RT | 35° C. | 4/6 Weeks 43° C. |
|---|---|---|---|---|---|---|
| 0 | 78 | 67 | 74 | 51 | 50 | 48 |
| 1 | 85 | 78 | 81 | 59 | 55 | 55 |
| 7 | 81 | 75 | 100 | 60 | 57 | 60 |
| 14 | 78 | 78 | 84 | 62 | 58 | 58 |
| PF-Free | 73 | 72 | 83 | 58 | 50 | 43 |

These results demonstrate the maintenance of relatively stable viscosities for the perfume-free and perfume-containing formulations whether perfumed immediately after formulation or after a period of days.

The product of this Example 3 was also diluted with both water, perfume and dye to provide a more dilute concentrate containing about 14% amido amine/esterquat and about 1.3% perfume. Dilution and post dilution viscosity data is shown in Table 6.

TABLE 6

| (days) | Brookfield Viscosity (cps) AM 1 day | | 4° C. | RT | 35° C. | 4/6 Weeks 43° C. |
|---|---|---|---|---|---|---|
| 0 | 43 | 42 | 43 | 37 | 35 | 34 |
| 1 | 45 | 45 | 47 | 42 | 40 | 38 |
| 7 | 48 | 47 | 47 | 42 | 40 | 38 |
| 14 | 42 | 46 | 45 | 41 | 39 | 39 |

The results demonstrate the maintenance of viscosity of the perfume-containing formulation after dilution with water.

What is claimed is:

1. A fabric softening composition in the form of an aqueous dispersion which is stable in the absence of oily perfume, comprising a mixture of:

(i) from about 3 to about 40% by weight of a fabric softener combination comprising a mixture of (A) and (B) wherein (A) is an inorganic acid salt of a fabric softening compound of formula (I):

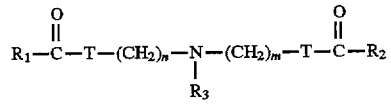

(I)

wherein $R_1$ and $R_2$ represent $C_{12}$ to $C_{30}$ aliphatic hydrocarbon groups, $R_3$ represents $(CH_2CH_2O)_pH$, $CH_3$ or H;

T represents O or NH;

n=1 to5, m=1 to 5, and p=1 to 10; and (B) is biodegradable fatty ester quaternary ammonium compound of formula (II):

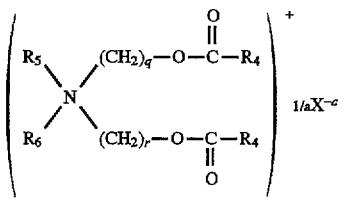

(II)

wherein each $R_4$, independently, represent an aliphatic hydrocarbon group having from 8 to 22 carbon atoms, $R_5$ represents $(CH_2)_s$-$R_7$ (where $R_7$ represents an alkoxy carbonyl group containing from 8 to 22 carbon atoms, benzyl, phenyl, $(C_1-C_4)$-alkyl substituted phenyl, OH or H); $R_6$ represents $(CH_2)_t$-$R_8$ (wherein $R_8$ represents benzyl, phenyl, $(C_1-C_4)$ alkyl substituted phenyl, OH or H); q, r, s and t, each independently represent a number of from 1 to 3; and x is an anion of valence a; and wherein at least about 20% of the hydrocarbon substituent groups present in components (A) and (B) are unsaturated;

(ii) a fatty ester of mono- or polyhydric alcohols having a hydrocarbon chain containing from 1 to about 24 carbon atoms and mono- polycarboxylic acids having a hydrocarbon chain containing from 1 to about 24 carbon atoms provided that the total number of carbon atoms in the ester is equal to or greater than 16 and that at least one of the hydrocarbon radicals in the ester has 12 or more carbon atoms, said fatty ester being present in the composition such that the weight ratio of component (i) to component (ii) is in the range of from about 40:1 to about 5:1; and (iii) an aqueous carrier including an anti gelling amount of electrolyte whereby in the absence of both an oily perfume and the fatty ester defined in (ii), said fabric softening composition manifests an unstable viscosity whereas in the presence of said fatty ester, the viscosity of said fabric softening composition is stabilized both in the presence of and in the absence of an oily perfume.

2. The composition of claim 1 wherein in the compound of formula (I):

T=NH $R_1$ and $R_2$=$C_{16}$ to $C_{22}$ alkyl or alkenyl;

m=1 to 3; n=1 to 3;

$R_3$=$(CH_2CH_2O)_pH$; and p=1.5 to 3.5.

3. The composition of claim 1 wherein in the compound of formula (II):

$R_5$ and $R_6$ are selected from the group consisting of $C_1$ to $C_4$ alkyl and $CH_2CH_2OH$, at least one or both of $R_5$ or $R_6$ being $CH_2CH_2OH$;

$R_4$ is an aliphatic hydrocarbon having from 14 to 18 carbon atoms; and

X is an anion selected from the group consisting of halo, sulfate, methosulfate, nitrate, acetate, phosphate, benzoate and oleate.

4. The composition of claim 1 wherein the weight ratio of (A):(B) is in the range of from about 5:1 to about 1:5 and the total unsaturation being less than 70% of the aliphatic hydrocarbon groups present in (A) and (B).

5. The composition of claim 1 wherein the total amount of (A) and (B) ranges from about 4 to about 30% by weight based on the total composition.

6. The composition of claim 5 wherein the weight ratio of component (i) to component (ii) ranges from about 28:1 to about 9:1.

7. The composition of claim 4 wherein the weight ratio of (A):(B) is in the range of from about 2:1 to 1:2.

8. The composition of claim 1 wherein said fatty ester component (ii) is selected from the group consisting of fatty esters of $C_{16}$ to $C_{18}$ unsaturated fatty acids and $C_1$ to $C_8$mono-or polyhydric alcohols.

9. The composition of claim 8 wherein said fatty acid ester has an HLB value in the range of from about 0.5 to 5.

10. The composition of claim 8 wherein said fatty alcohol is selected from the group consisting of sorbitan monooleate, sorbitan trioletate, pentaerythritol monooleate, glycerol monooleate, polyglycerol monooleate methyl oleate and mixtures thereof.

11. The composition of claim 10 wherein said fatty alcohol is glycerol monooleate.

12. The composition of claim 1 wherein fatty ester component (ii) is present in the composition at a level of from about 0.2 to about 2% by weight.

13. The composition of claim 1 wherein said component (A) is selected from the group consisting of salts of bis (tallowamidoethyl)-2-hydroxyethylamine, bis(hydrogenated-tallowaminoethyl)-2-hydroxyethylamine and mixtures thereof.

14. The composition of claim 13 wherein said component (B) is N-methyl-N,N,N-triethanolamine-ditallow diester quaternary ammonium methosulfate.

15. The composition of claim 1 which additionally contains a protonic acid sufficient to at least partially neutralize component (A).

16. The composition of claim 15 wherein said acid is HCl.

17. The composition of claim 1 wherein said electrolyte is an alkali or alkaline earth metal salt present in said composition at a level of from about 0.0075 to about 2% by weight.

18. The composition of claim 17 wherein said electrolyte is $CaCl_2$.

19. The composition of claim 1 in the form of a fabric softener concentrate having a content of active ingredients in the range of from about 10 to about 35% by weight.

20. The composition of claim 1 further containing from about 0.25 to about 3% by weight of added perfume.

21. The composition of claim 1 which is free of added perfume.

22. A method of imparting softness to fabrics comprising contacting the fabrics with a softening effective amount of the fabric softener composition of claim 1.

23. The method of claim 22 wherein said contacting is in the rinse cycle of an automatic washing machine.

24. The method of claim 22 wherein said fabric softener composition is diluted with from about 1 to about 6 volumes of water per volume of fabric softener composition prior to use in the rinse cycle of an automatic laundry washing machine.

25. The method of claim 22 wherein said fabric softener composition is free of added perfume and is mixed with perfume prior to use in the rinse cycle of an automatic laundry washing machine.

26. The method of claim 25 wherein from about 0.25 to about 3% by weight of perfume is mixed with said fabric softener composition prior to use in the rinse cycle of an automatic laundry washing machine.

* * * * *